US006122478A

United States Patent [19]

Hirst

[11] Patent Number: 6,122,478

[45] Date of Patent: Sep. 19, 2000

[54] REDUCTION OF THERMALLY INDUCED MECHANICAL STRESS IN A FIXING DEVICE

[75] Inventor: B. Mark Hirst, Boise, Id.

[73] Assignee: Hewlett-Packard Company, Palo Alto, Calif.

[21] Appl. No.: 09/368,434

[22] Filed: Aug. 4, 1999

[51] Int. Cl.[7] ..... G03G 15/20

[52] U.S. Cl. ..... 399/330; 219/216; 399/328; 430/124

[58] Field of Search ..... 399/330, 328, 399/329, 335; 219/216, 50, 61.1, 469; 430/97, 99, 124

[56] References Cited

U.S. PATENT DOCUMENTS 5,499,087 3/1996 Hiraoka et al. ..... 399/329
5,499,088 3/1996 Menjo ..... 399/328 X
5,660,750 8/1997 Kusaka ..... 219/216
5,753,361 5/1998 Visser ..... 428/323
5,765,085 6/1998 Law et al. ..... 399/329
5,837,340 11/1998 Law et al. ..... 428/36.8
5,842,085 11/1998 Mitsuya ..... 399/122
5,874,710 2/1999 Yoshimoto et al. ..... 219/216

*Primary Examiner*—Sophia S. Chen
*Attorney, Agent, or Firm*—Gregg W. Wisdom

[57] ABSTRACT

A fixing device includes a compliant material positioned between a heating member and a support member. Cyclical heating of the fixing device induces differing amounts of thermal expansion in the support member and the heating member. Deformation of the compliant material reduces the thermally induced mechanical stresses that would have been experienced by the heating member had the heating member been rigidly attached to the support member. Reducing the thermally induced mechanical stresses experienced by the heating member reduces the likelihood of failure of the heating member resulting from fracturing of the heating member.

16 Claims, 5 Drawing Sheets

REDUCTION OF THERMALLY INDUCED MECHANICAL STRESS IN A FIXING DEVICE

FIELD OF THE INVENTION

This invention relates to electrophotographic imaging systems. More particularly, this invention relates to fixing devices used within electrophotographic imaging systems.

BACKGROUND OF THE INVENTION

Fixing devices are used to fix toner to media in electrophotographic imaging systems. The fixing process involves the application of heat to the media and toner by the fixing device. To reduce power consumption, the power supplied to the fixing device is typically reduced from the level applied during fixing, when the fixing operation is not performed. The time varying application of power to the fixing device results in successive cycles of heating and cooling. The successive cycles of heating and cooling can cause failures from thermally induced mechanical stresses in the fixing device. A need exists for a fixing device having reduced levels of thermally induced mechanical stresses.

SUMMARY OF THE INVENTION

Accordingly, a fixing device has been developed to reduce the levels of thermally induced mechanical stresses. The fixing device includes a support member and a heating member. The fixing device further includes a compliant material positioned between the support member and the heating member.

An electrophotographic imaging system for forming images on media using toner includes a photoconductor to generate a latent electrostatic image and a developing device to develop toner onto the latent electrostatic image. The electrophotographic imaging system further includes a transfer device to move the toner from the photoconductor to the media. The electrophotographic imaging system also includes a fixing device to fix toner to the media. The fixing device includes a substrate, a heating element disposed upon the substrate, a base, and a compliant material interposed between the base and the substrate.

A fixing device includes a compliant material and a heating member. A method for reducing thermally induced mechanical stress in the fixing device includes supplying a first value of power to the heating member and heating the heating member. The method further includes changing the compliant material from a first shape to a second shape.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The fixing device is not limited to the specific exemplary embodiments illustrated in this specification. Although the embodiments of the fixing device will be discussed in the context of a monochrome electrophotographic printer, one of ordinary skill in the art will recognize by understanding this specification that the fixing device has applicability in both color and monochrome electrophotographic imaging systems. Furthermore, although the embodiments of the fixing device will be discussed in the context of a monochrome electrophotographic printer, one of ordinary skill in the art will recognize by understanding this specification that other types of electrophotographic imaging systems, such as electrophotographic copiers (either color or monochrome) could use the fixing device control system.

Figure 1:
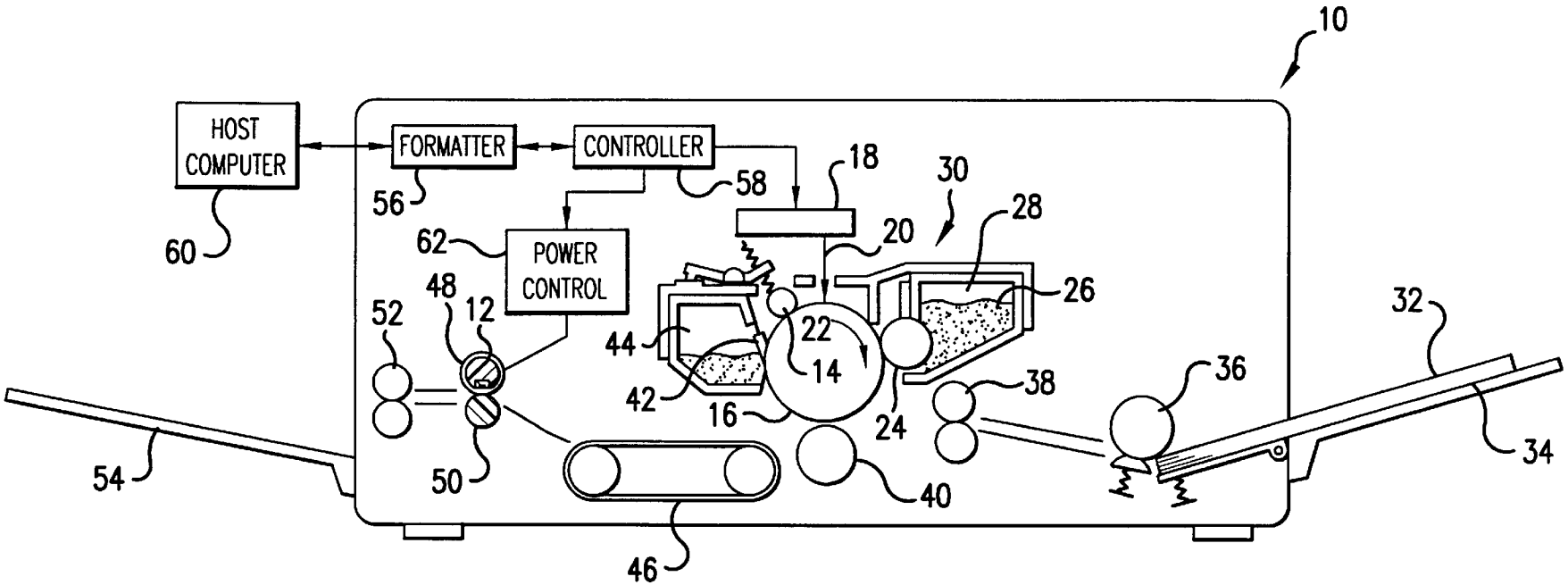
FIG. 1 is a simplified cross section of an electrophotographic printer including an embodiment of the fixing device.

Referring to FIG. 1, shown is a simplified cross sectional view of an embodiment of an electrophotographic imaging system, electrophotographic printer 10, containing an embodiment of a fixing device, such as fuser 12, shown in cross section. Fuser 12 is an instant on type fuser that includes an embodiment of a heating member having a resistive heating element located on a substrate. It should be recognized that although the disclosed embodiment of the fixing device is discussed in the context of electrophotographic printer 10, it could also be used in other types of electrophotographic imaging systems, such as electrophotographic copiers.

Charge roller 14 is used to charge the surface of a photoconductor, such as photoconductor drum 16, to a predetermined voltage. A laser diode (not shown) inside laser scanner 18 emits a laser beam 20 which is pulsed on and off as it is swept across the surface of photoconductor drum 16 to selectively discharge the surface of the photoconductor drum 16. Photoconductor drum 16 rotates in the clockwise direction as shown by the arrow 22. A developing device, such as developing roller 24, is used to develop the latent electrostatic image residing on the surface of photoconductor drum 16 after the surface voltage of the photoconductor drum 16 has been selectively discharged. Toner 26, which is stored in the toner reservoir 28 of electrophotographic print cartridge 30, moves from locations within the toner reservoir 28 to the developing roller 24. A magnet located within the developing roller 24 magnetically attracts the toner to the surface of the developing roller 24. As the developing roller 24 rotates in the counterclockwise direction, the toner 26, located on the surface of the developing roller 24 opposite the areas on the surface of photoconductor drum 16 which are discharged, can be moved across the gap between the surface of the photoconductor drum 16 and the surface of the developing roller 24 to develop the latent electrostatic image.

Media, such as print media 32 is loaded from paper tray 34 by pickup roller 36 into the paper path of the electrophotographic printer 10. Print media 32 moves through the drive rollers 38 so that the arrival of the leading edge of print media 32 below photoconductor drum 16 is synchronized with the rotation of the region on the surface of photoconductor drum 16 having a latent electrostatic image corresponding to the leading edge of print media 32. As the photoconductor drum 16 continues to rotate in the clockwise direction, the surface of the photoconductor drum 16, having toner adhered to it in the discharged areas, contacts the print media 32 which has been charged by a transfer device, such as transfer roller 40, so that it attracts the toner particles away from the surface of the photoconductor drum 16 and onto the surface of the print media 32. The transfer of toner particles from the surface of photoconductor drum 16 to the surface of the print media 32 is not fully efficient and therefore some toner particles remain on the surface of photoconductor drum 16. As photoconductor drum 16 continues to rotate, toner particles, which remain adhered to its surface, are removed by cleaning blade 42 and deposited in toner waste hopper 44.

As the print media 32 moves in the paper path past photoconductor drum 16, conveyer 46 delivers the print media 32 to fuser 12. Print media 32 passes between pressure roller 50 and the sleeve 48 of fuser 12. Pressure roller 50 is coupled to a gear train (not shown in FIG. 1) in electrophotographic printer 10. Print media 32 passing between pressure roller 50 and fuser 12 is forced against sleeve 48 of fuser 12 by pressure roller 50. As pressure roller 50 rotates, sleeve 48 is rotated and print media 32 is pulled between sleeve 48 and pressure roller 50. Heat applied to print media 32 by fuser 12 fixes toner 26 to the surface of print media 32. Output rollers 52 push the print media 32 into the output tray 54 after it exits fuser 12.

The embodiment of the electrophotographic imaging system shown in FIG. 1, electrophotographic printer 10, includes formatter 56 and controller 58. Formatter 56 receives print data, such as a display list, vector graphics, or raster print data, from the print driver operating in conjunction with an application program in host computer 60. Formatter 56 converts this relatively high level print data into a stream of binary print data. Formatter 56 sends the stream of binary print data to controller 58. In addition, formatter 56 and controller 58 exchange data necessary for controlling the electrophotographic printing process. Controller 58 supplies the stream of binary print data to laser scanner 18. The binary print data stream sent to the laser diode in laser scanner 18 pulses the laser diode to create the latent electrostatic image on photoconductor drum 16.

In addition to providing the binary print data stream to laser scanner 18, controller 58 controls a high voltage power supply (not shown in FIG. 1) to supply voltages and currents to components used in the electrophotographic processes such as charge roller 14, developing roller 24, and transfer roller 40. Furthermore, controller 58 controls the drive motor (not shown in FIG. 1) that provides power to the printer gear train and controller 58 controls the various clutches and paper feed rollers necessary to move print media 32 through the print media path of electrophotographic printer 10.

A power control circuit 62 controls the application of power to fuser 12. While electrophotographic printer 10 is waiting to begin processing a print job, the temperature of fuser 12 is kept at a standby temperature corresponding to a standby mode. In the standby mode, power is supplied at a reduced level to fuser 12 by power control circuit 62 to reduce power consumption, lower the temperature, and reduce the degradation resulting from continued exposure to fixing temperatures of components (such as pressure roller 50) associated with fuser 12. The standby temperature of fuser 12 is selected to balance a reduction in component degradation achieved by a low temperature against the time required to heat fuser 12 from the standby temperature to the fixing temperature. From the standby temperature, fuser 12 can quickly be heated to the fixing temperature, necessary for fixing toner 26 to print media 32. When processing of a print job begins, controller 58 will, sufficiently ahead of the arrival of print media 32 at fuser 12, increase the power supplied by the power control circuit to fuser 12 to bring its temperature up to the fixing temperature. After completion of the print job, the controller sets the power control circuit to reduce the power supplied to fuser 12 to a level corresponding to the standby mode. The cycling of the power supplied to fuser 12 is ongoing during the operation of electrophotographic printer 10 as print jobs are received and processed and while electrophotographic printer 10 is idle.

Figure 2A:
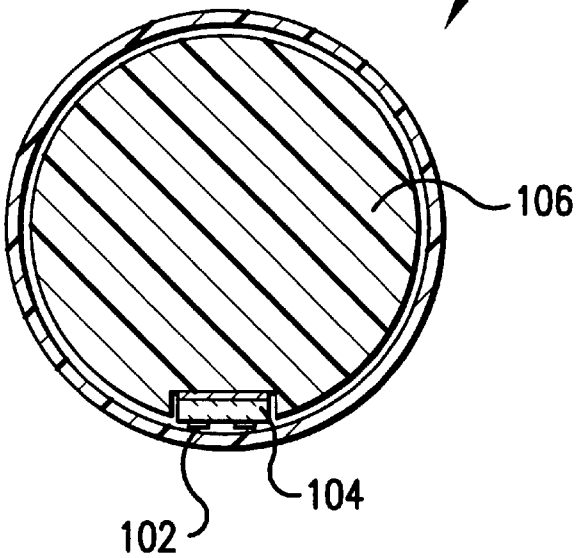
FIG. 2 shows a simplified drawing of a conventional fixing device including a cross sectional view.
Figure 2:
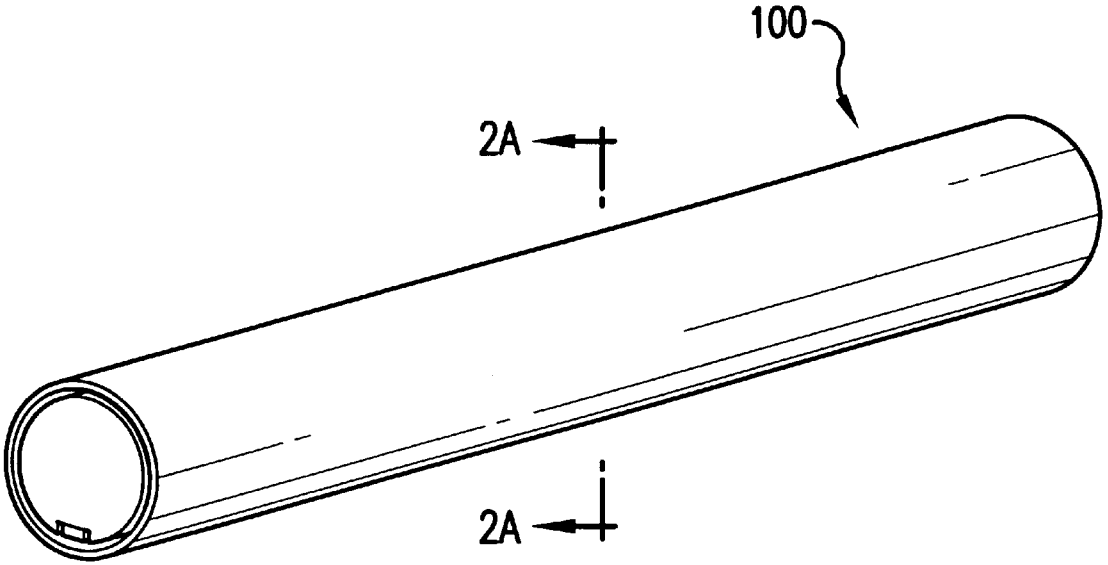

Shown FIG. 2 is a simplified cross sectional view of a typical "instant-on" fuser 100. An instant-on fuser typically includes a heating element 102. Heating element 102 is usually screened onto the surface of a substrate 104. Substrate 104 is bonded to a support member 106. Usually, the mechanical attachment between substrate 104 and support member 106 is made with epoxy at locations over the length of substrate 104. A material frequently used for support member 106 is a glass filled plastic that is flame resistant and maintains its mechanical rigidity at the temperatures required for fixing. Substrate 104 is typically constructed from ceramic. Generally, the materials used for support member 106 and substrate 104 have different coefficients of thermal expansion. Because of the differing coefficients of thermal expansion, and the rigid bonding of substrate 104 to support member 106, a change in temperature of fuser 100 results in the generation of thermally induced mechanical stresses in substrate 104 and support member 106. However, even if substrate 104 and support member 106 are constructed from the same materials, unequal rates of heating could generate mechanical stresses in substrate 104 and support member 106 by causing different percentage changes in the dimensions of substrate 104 and support member 106 before thermal equilibrium is achieved. During the normal usage of fuser 100, it is subjected to repeated thermal cycling as it is heated from the standby temperature to the fixing temperature at the beginning of a print job and then allowed to cool to the standby temperature. The repeated thermal cycling subjects fuser 100 to repeated thermally induced mechanical stresses.

Overtime, the thermally induced mechanical stresses generated in substrate 104 by the thermal cycling of fuser 100 can result in fractures in substrate 104. The fracturing of substrate 104 may result in a break in continuity in heating element 102, thereby causing a failure of fuser 100. Reducing the thermally induced mechanical stresses resulting from differing coefficients of thermal expansion or unequal heating would improve the reliability of fuser 100.

Figure 3:
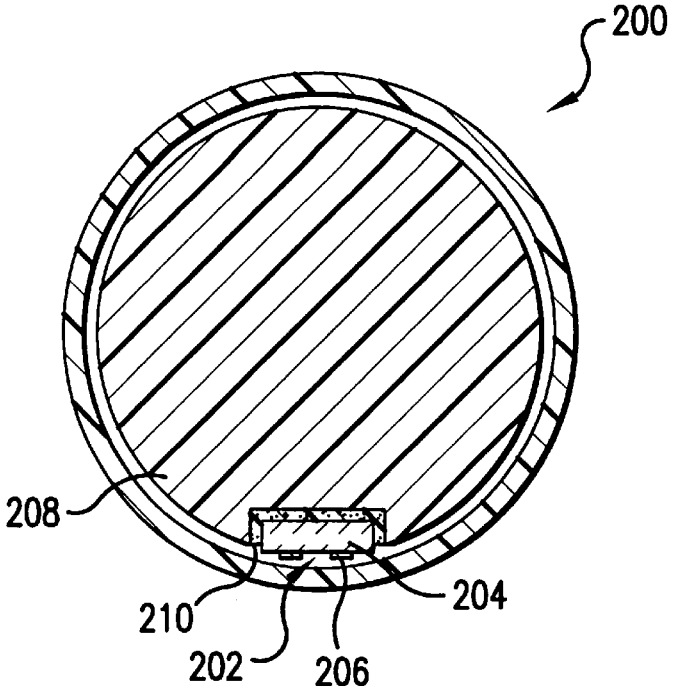
FIG. 3 shows a simplified cross sectional view of a first embodiment of the fixing device.

Shown in FIG. 3 is a simplified cross sectional view of a first embodiment of a fixing device 200 that could be used for instant on fuser 12. The first embodiment of fixing device 200 includes a heating member 202. Heating member 202 includes a substrate 204, constructed of, for example, ceramic and having a heating element 206. Heating element 206 may be formed from a thick film resistor screened onto the surface of substrate 204. Alternatively, substrate 204 may be formed from a flame resistant plastic, such as a polyimide material. Heating element 206 may, alternatively, be formed from a resistive element, such as ni-chrome wire, attached to the surface of substrate 204. Support member 208 serves as a rigid mechanical support for the mounting of the first embodiment of fixing device 200 onto the appropriate structure of electrophotographic printer 10. Positioned between substrate 204 and support member 208 is a compliant material 210, such as a felted wool, an elastomer, or another type of material having compliant characteristics. In the first embodiment of fixing device 200, substrate 204 is attached to the surface of the compliant material 210 it contacts. In addition, support member 208 is attached to the surface of the compliant material 210 it contacts. The attachment of substrate 204 and support member 208 to compliant material 210 may be done using a high temperature epoxy or other suitable adhesive. To allow thermal equilibrium to be rapidly achieved between substrate 204 and support member 208 (thereby reducing the thermally induced mechanical stresses) a thermally conductive high temperature epoxy could be used to attach substrate 204 and support member 208 to the corresponding surfaces on compliant material 210.

Figure 4:
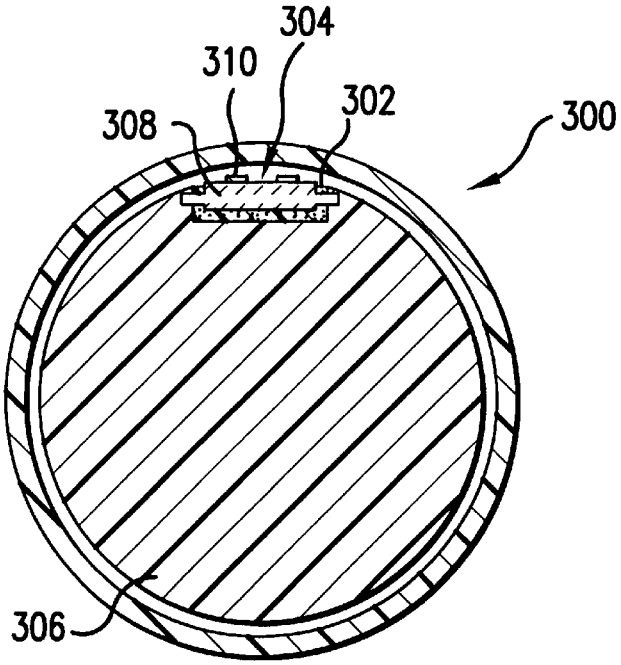
FIG. 4 shows a simplified cross sectional view of a second embodiment of the fixing device.

Shown in FIG. 4 is a simplified cross sectional view of a second embodiment of a fixing device 300 that could be used for instant on fuser 12. In the second embodiment of fixing device 300, compliant material 302 is positioned between heating member 304 and support member 306. Heating member 304 includes a substrate 308 and a heating element 310. However, in the second embodiment of fixing device 300, heating member 304 and support member 306 are not attached to the surfaces of compliant material 302 which they contact.

Figure 5:
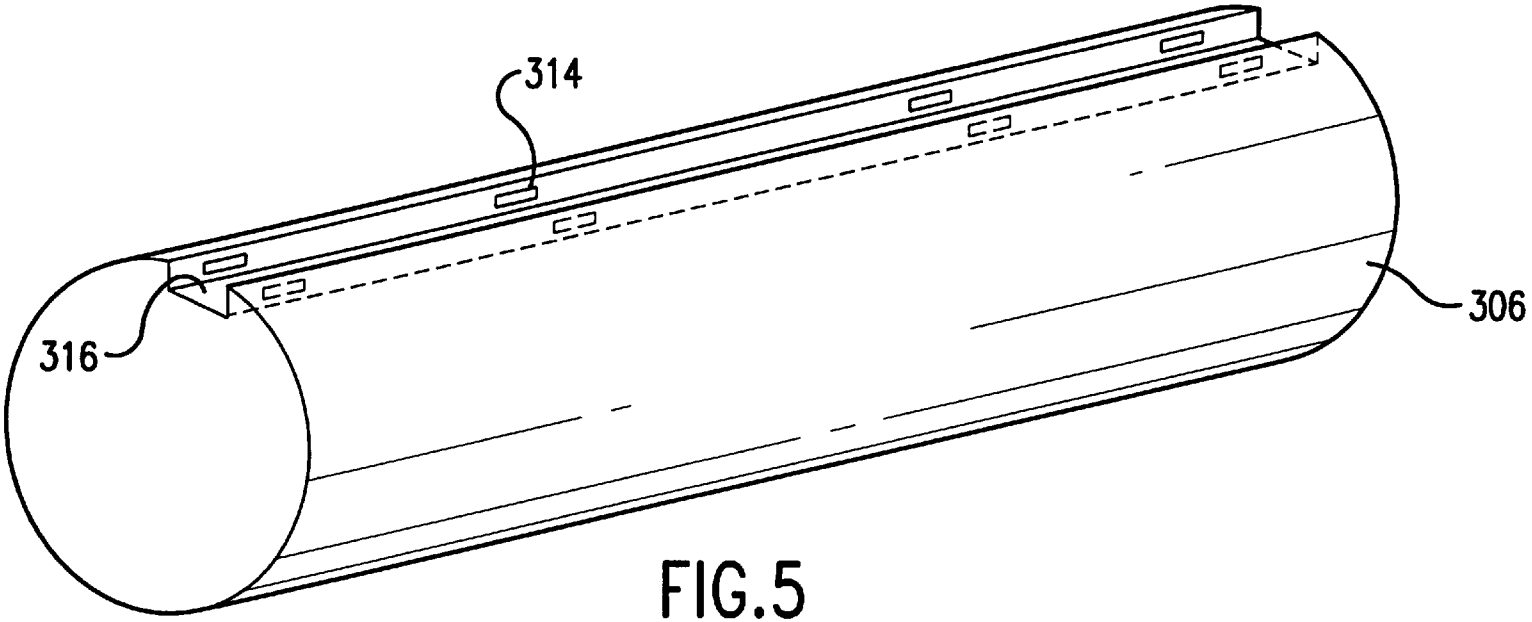
FIG. 5 shows a simplified drawing of a support member used in the second embodiment of the fixing device.
Figure 6:
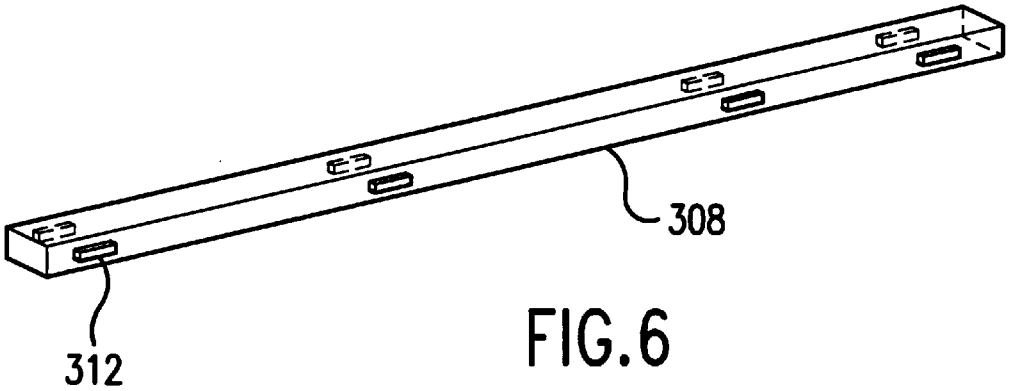
FIG. 6 shows a simplified drawing of a substrate used in the second embodiment of the fixing device.

Shown in FIG. 5 is a simplified drawing of support member 306. Shown in FIG. 6 is a simplified view of substrate 308. Tabs, of which tab 312 is an example, on the sides of substrate 308 fit into slots, of which slot 314 is an example, formed into the sides of the channel 316 of support member 306. Substrate 308 is located into channel 316 when the second embodiment of fixing device 300 is assembled. The slots are positioned on support member 306 so that when substrate 308 is located in channel 316 with the tabs inserted into the slots, compliant material 302 (not shown in FIG. 5 or FIG. 6) is partially compressed between heating member 304 and support member 306. The partial compression of compliant material 302 generates a reaction force from the compliant material 302 that forces the tabs of substrate 308 against the top of the slots in channel 316 so that the top surface of the tabs contacts the top surface of the slots. This reaction force holds heating member 304 in place in channel 316. The tabs on substrate 308 are sized so that when the tabs are inserted into the corresponding slots in support member 306, the side, bottom, and end surface of the tabs do not contact the corresponding interior surfaces of the slots.

Locating heating member 304 in channel 316 with compliant material 302 partially compressed and the tabs not contacting the sides of the slots allows for a reduction in thermally induced mechanical stresses resulting from differing coefficients of thermal expansion in heating member 304 and support member 306 or unequal heating. Mechanical stress resulting from thermal expansion in a vertical and horizontal direction perpendicular to the long axis of heating member 304 is relieved by further compression of compliant material 302. Mechanical stress resulting from thermal expansion in a direction parallel to the long axis of heating member 304 is reduced because of the gap between the sides of the tabs and the sides of the corresponding slots.

The second embodiment of the fixing device illustrated in FIGS. 4, 5, and 6 uses a plurality of tabs and slots on each side of, respectively, substrate 308 and channel 316. However, it should be recognized that by making a tab and slot of a sufficiently large size, a variation of the second embodiment of the fixing device could be made using a single slot and a single tab on each side of, respectively, substrate 308 and channel 316.

By positioning a compliant material between heating member 202, 304 and support member 208, 306, the thermally induced mechanical stresses experienced by heating member 202, 304 are significantly reduced. When power is applied to heating element 206, 310, both substrate 204, 308 and support member 208, 306 are heated. The different coefficients of thermal expansion of the materials used for substrate 204, 308 and support member 208, 306, or unequal heating, cause different fractional changes in the sizes of substrate 204, 308 and support member 208, 306. By positioning a compliant material between substrate 204, 308 and support member 208, 306, the thermally induced mechanical stresses that would have resulted from rigidly bonding substrate 204, 308 to support member 208, 306 are reduced. When the dimensions of substrate 204, 308 and support member 208, 306 change at different rates, compliant material 210, 302 deforms to compensate for the differing thermal coefficients of expansion of substrate 204, 308 and support member 208, 306, or unequal heating, thereby reducing thermally induced mechanical stresses. The reduction in thermally induced mechanical stresses reduces the likelihood of fracturing substrate 204, 308 and subsequent failure of heating element 206, 310.

A range of values of the thickness of compliant material 210, 302 can provide an effective reduction in the thermally induced stress experienced by substrate 204, 308. The range of useful values of the thickness of compliant material 210, 302 will depend, in part, upon the thickness of substrate 204, 308, the coefficients of thermal expansion of substrate 204, 308 and support member 208, 306, and the relative rates of heating of substrate 204, 308 and support member 208, 306. As print media 32 passes between fuser 12 and pressure roller 50, pressure roller 50 forces print media 32 against fuser 12. Because compliant material 210, 302 is positioned between substrate 204, 308 and support member 208, 306, forcing print media 32 against fuser 12 results in the compression of compliant material 210, 302 and the bending of substrate 204, 308.

The amount of bending experienced by substrate 204, 308 depends in part upon the thickness of compliant material 210, 302 and the force exerted by pressure roller 50. A relatively large thickness of compliant material 210, 302 has a greater change in thickness in going from an uncompressed condition to a fully compressed condition than a relatively small thickness of compliant material 210, 302. Therefore, for a given amount of force exerted by pressure roller 50 and a relatively large thickness of compliant material 210, 302, substrate 204, 308 would experience more bending than would occur with a relatively small thickness of compliant material 210, 302 subjected to the same amount of force.

Determining the upper limit of the thickness of compliant material 210, 302 useable in the first embodiment 200 and second embodiment 300 of the fixing device includes consideration of the maximum bending substrate 204, 308 can tolerate without fracturing. Determining the lower limit of the thickness of compliant material 210, 302 includes consideration of the amount of deformation required from compliant material 210, 302 to relieve the thermally induced mechanical stresses.

An elastomer manufactured by Chromeric Corporation provides acceptable performance for use as compliant material 210, 302. The Chromeric elastomer material designation is 62-07-0808-A274. A thickness of this material type ranging from 1/32 to 1/16 inches will provide acceptable performance. An additional advantage of the tested Chromeric material type is its thermal conductivity. Thermal conductivity of compliant material 210, 302 permits a reduction in the time required to reach thermal equilibrium between support member 208, 306 and substrate 204, 308, thereby reducing the dimensional changes of support member 208, 306 relative to substrate 204, 308 that give rise to the thermally induced mechanical stresses. Although thermal conductivity of compliant material 210, 302 is a desirable property, it is not necessary for compliant material 210, 302 to have a relatively high thermal conductivity to perform in relieving the thermally induced mechanical stresses. It should be emphasized that the disclosed material type and thickness are only examples of a material type and thickness that will provide acceptable performance. Depending upon the characteristic substrate 204, 308 and support member 208, 306, a wide range of values of the thickness and material types may be suitable for use as compliant material 210, 302.

As previously mentioned, materials other than an elastomer may be used for compliant material 210, 302 positioned between substrate 204, 308 and support member 208, 306. For example, a felted woolen material could be used for compliant material 210, 302. Or, as another example, a double sided adhesive tape formed of a sponge rubber type material could be used as compliant material 210, 302. Other materials could be used for compliant material 210, 302. The important performance characteristic is that the material has sufficient compliance to reduce the thermally induced mechanical stresses in substrate 204, 308 to levels that significantly reduce the likelihood of fracturing in substrate 204, 308 from thermally induced mechanical stress.

Figure 7:
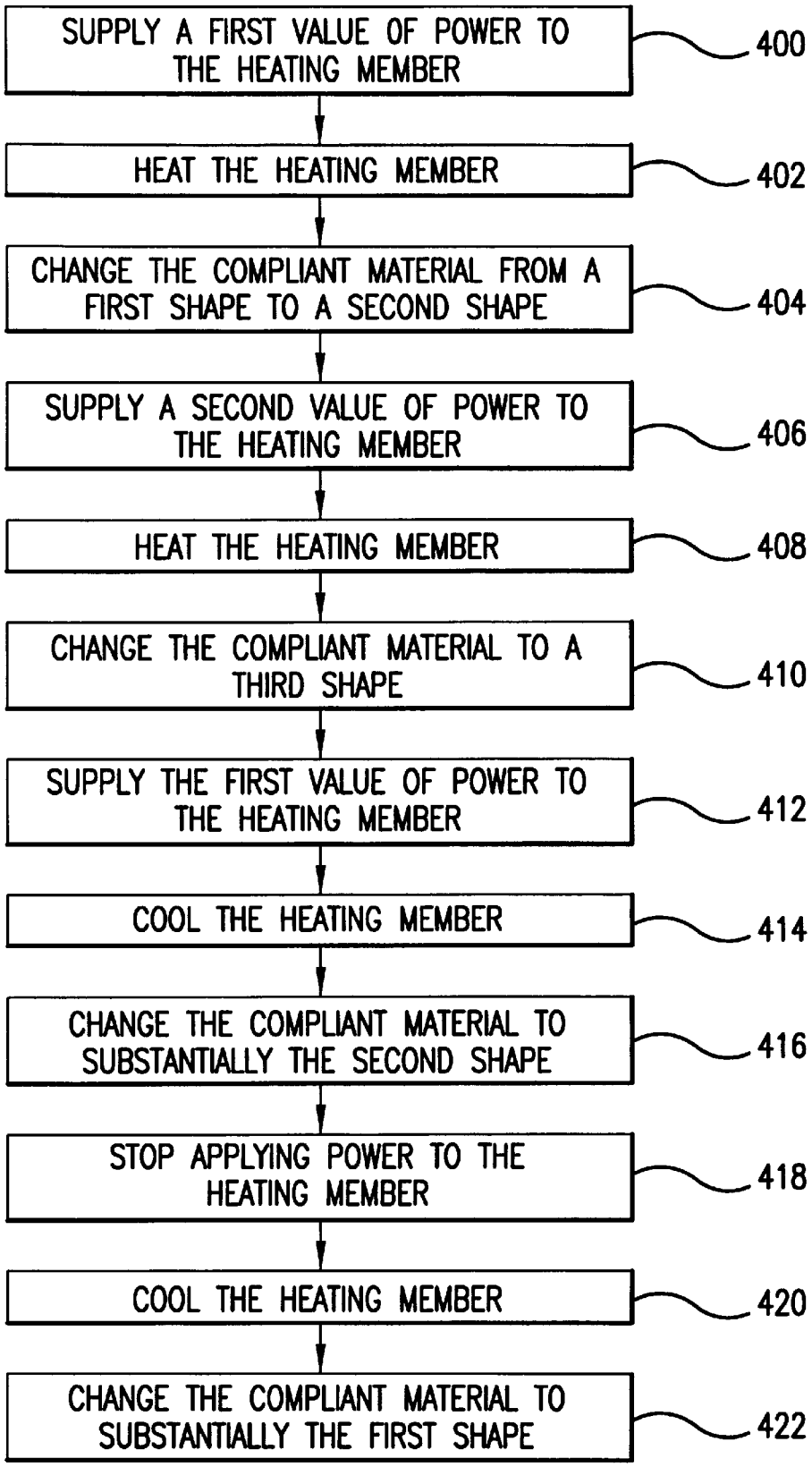
FIG. 7 shows a high level flow diagram of a method for using the first embodiment or second embodiment of the fixing device.

Shown in FIG. 7 is a high level flow diagram of a method for using either the first embodiment or the second embodiment of the fixing device to relieve thermally induced mechanical stress. First, in step 400, a first value of power is supplied to heating member 202, 304. Then, in step 402, heating member 202, 304 is heated. The heating of heating member 202, 304 causes an increase in the temperature of fixing device 200, 300. The increase in the temperature of fixing device 200, 300 causes an expansion of components within fixing device 200, 300. Next, in step 404, the shape of compliant material 210, 302 changes from a first shape to a second shape to reduce the buildup of thermally induced mechanical stress. The first value of power supplied to heating member 202, 304 could be that necessary for maintaining fixing device 200, 300 at the standby temperature. Alternatively, the first value of power supplied to heating element 202, 304 could be that necessary for maintaining fixing device 200, 300 at the fixing temperature.

In step 406, a second value of power is supplied to heating member 202, 304. Next, in step 408, heating member 202, 304 is heated. Then, in step 410, compliant material 210, 302 is changed to a third shape to reduce the buildup of thermally induced mechanical stress. Next, in step 412, the first value of power is supplied to the heating member 202, 304. Then, in step 414, heating member 202, 304 is cooled. Next, in step 416, compliant material 210, 302 is changed to substantially the second shape. Depending upon the material used for compliant material 210, 302, it is possible that it may undergo some degree of permanent deformation, so that even when the power supplied to heating member 202, 304 is changed to a previous value (for example, from the fixing temperature back to the standby temperature), the shape of compliant material 210, 302 only returns to substantially the previous shape. In step 418, the application of power to the heating member 202, 304 is stopped. Then, in step 420, heating member 202, 304 is cooled. Finally, in step 422, compliant material 210, 302 is changed to substantially the first shape.

Although several embodiments of the invention have been illustrated, and their forms described, it is readily apparent to those of ordinary skill in the art that various modifications may be made to these embodiments without departing from the spirit of the invention or from the scope of the appended claims.

What is claimed is:

1. A fixing device, comprising:

a support member;

a heating member; and a felted wool material positioned between the support member and the heating member.

2. A fixing device, comprising:

a heating member including a substrate formed from a rigid material and having a plurality of protruding tabs and a heating element disposed on the substrate;

a compliant material; and a support member including a channel shaped for receiving the substrate, with the compliant material positioned in the channel between the substrate and the support member and with the support member including a plurality of slots in the channel positioned for receiving the tabs so that compression of the compliant material results.

3. The fixing device as recited in claim 2, wherein:

the compliant material includes an elastomer.

4. The fixing device as recited in claim 3, wherein:

the rigid material includes a polyimide material.

5. The fixing device as recited in claim 4, wherein:

the heating element includes a ni-chrome wire.

6. The fixing device as recited in claim 3, wherein:

the rigid material includes ceramic; and the heating element includes a thick film resistive element.

7. The fixing device as recited in claim 3, wherein:

the elastomer includes a thermally conductive elastomer.

8. The fixing device as recited in claim 2, wherein:

the compliant material includes a felted wool.

9. An electrophotographic imaging system for forming images on media using toner, comprising:

a photoconductor to generate a latent electrostatic image;

a developing device to develop toner onto the latent electrostatic image;

a transfer device to move the toner from the photoconductor to the media; and a fixing device to fix toner to the media, with the fixing device including a heating member having a substrate formed from a rigid material with a plurality of protruding tabs and having a heating element disposed on the substrate, a compliant material and a support member including a channel shaped for receiving the substrate with the compliant material positioned in the channel between the substrate and the support member and with the support member including a plurality of slots in the channel positioned for receiving the tabs so that compression of the compliant material results.

10. The electrophotographic imaging system as recited in claim 9, wherein:

the compliant material includes a felted wool.

11. The electrophotographic imaging system as recited in claim 9, wherein:

the compliant material includes an elastomer.

12. The electrophotographic imaging system as recited in claim 11, wherein:

the rigid material includes ceramic; and the heating element includes a thick film resistive element.

13. In a fixing device including a compliant material and a heating member, a method for reducing thermally induced mechanical stress, comprising:

supplying a first value of power, necessary for maintaining the fixing device at a standby temperature, to the heating member;

heating the heating member; and changing the compliant material from a first shape to a second shape.

14. The method as recited in claim 13, further comprising:

supplying a second value of power to the heating member;

heating the heating member, where the second value of power includes the power necessary for maintaining the fixing device at a fixing temperature; and changing the compliant material to a third shape.

15. The method as recited in claim 14, further comprising:

supplying the first value of power to the heating member;

cooling the heating member; and changing the compliant material to substantially the second shape.

16. The method as recited in claim 15, further comprising:

stopping application of power to the heating member;

cooling the heating member; and changing the compliant material to substantially the first shape.

* * * * *